US009157330B2

(12) United States Patent
Garin et al.

(10) Patent No.: US 9,157,330 B2
(45) Date of Patent: Oct. 13, 2015

(54) LAYOUT OF A BLISK

(75) Inventors: Fabrice Marcel Noel Garin, Boissise la Bertrand (FR); Romain Nicolas Lunel, Montereau sur le Jard (FR); Bruno Andre Jean Varin, Paris (FR); Clement Roussille, Bordeaux (FR)

(73) Assignees: SNECMA, Paris (FR); HERAKLES, Le Haillan (FR)

( * ) Notice: Subject to any disclaimer, the term of this patent is extended or adjusted under 35 U.S.C. 154(b) by 527 days.

(21) Appl. No.: 13/520,433

(22) PCT Filed: Jan. 11, 2011

(86) PCT No.: PCT/EP2011/050245

§ 371 (c)(1),
(2), (4) Date: Jul. 3, 2012

(87) PCT Pub. No.: WO2011/086056

PCT Pub. Date: Jul. 21, 2011

(65) Prior Publication Data

US 2012/0308391 A1 Dec. 6, 2012

(30) Foreign Application Priority Data

Jan. 12, 2010 (FR) ..... 10 50164

(51) Int. Cl.
*F01D 5/30* (2006.01)

(52) U.S. Cl.
CPC ..... *F01D 5/3084* (2013.01); *F01D 5/3092* (2013.01); *F05D 2230/60* (2013.01); *F05D 2250/71* (2013.01); *F05D 2260/30* (2013.01)

(58) Field of Classification Search
CPC . F01D 5/3084; F01D 5/3092; F05D 2230/60; F05D 2250/71; F05D 2260/30
USPC ..... 416/193 A, 219 R, 220 R, 221
See application file for complete search history.

(56) References Cited

U.S. PATENT DOCUMENTS

| | | | | |
|---|---|---|---|---|
| 2,950,083 | A | 8/1960 | Compton et al. | |
| 3,132,841 | A | 5/1964 | Wilder, Jr. | |
| 4,417,854 | A * | 11/1983 | Cain et al. | 416/241 B |
| 4,802,824 | A * | 2/1989 | Gastebois et al. | 416/193 A |
| 6,619,924 | B2 * | 9/2003 | Miller | 416/220 R |
| 7,713,029 | B1 * | 5/2010 | Davies | 416/219 R |

(Continued)

FOREIGN PATENT DOCUMENTS

| | | |
|---|---|---|
| EP | 2 077 376 | 7/2009 |
| FR | 2 608 674 | 6/1988 |

OTHER PUBLICATIONS

U.S. Appl. No. 14/449,308, filed Aug. 1, 2014, Garin, et al.

(Continued)

*Primary Examiner* — Dwayne J White
*Assistant Examiner* — Brian P Wolcott
(74) *Attorney, Agent, or Firm* — Oblon, McCelland, Maier & Neustadt, L.L.P.

(57) ABSTRACT

A layout of a blisk includes two inserts housed between the bulb of the blade and the wall of a groove in a disk to compensate for variations in inclination between the overhanging faces of the groove and the upper faces of the bulb at their central part. This construction makes it possible to select blades for which upper faces of the bulb are slightly inclined relative to the radial direction, which facilitates their construction from a composite material.

7 Claims, 1 Drawing Sheet

(56) References Cited

U.S. PATENT DOCUMENTS

| | | | | |
|---|---|---|---|---|
| 8,206,118 | B2 * | 6/2012 | Propheter-Hinckley et al. | 416/219 R |
| 2010/0284816 | A1 | 11/2010 | Propheter-Hinckley et al. | |
| 2014/0003924 | A1 | 1/2014 | Bonneau et al. | |

OTHER PUBLICATIONS

International Search Report Issued Apr. 14, 2011 in PCT/EP11/50245 Filed Jan. 11, 2011.

* cited by examiner

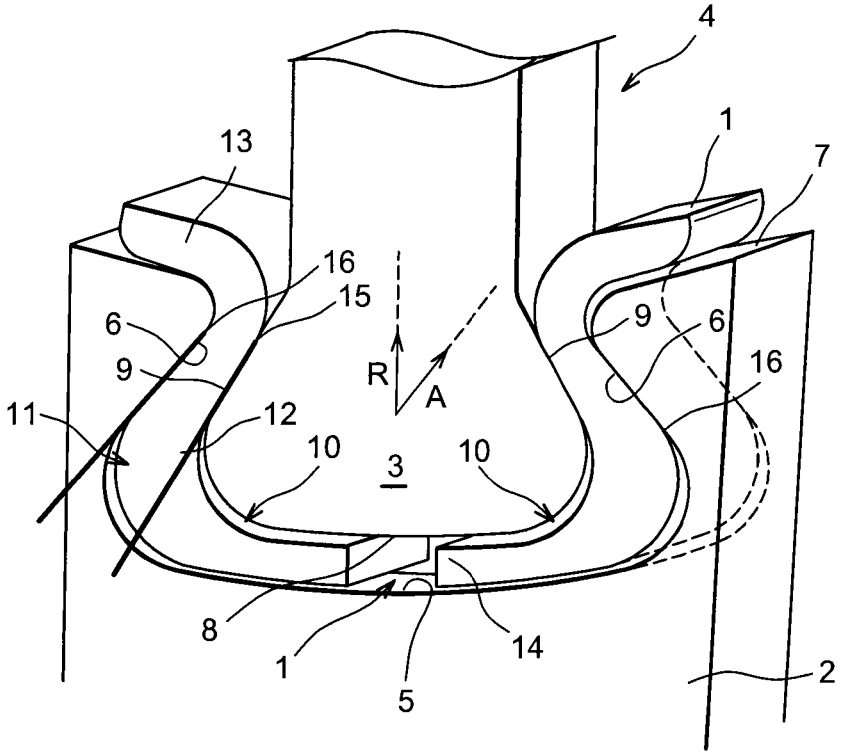
4
1
7
13
16
15
6
9
R
A
9
6
16
11
12
10
3
10
8
1
5
14
2

LAYOUT OF A BLISK

BACKGROUND OF THE INVENTION

1. Field of the Invention

The subject of this invention is a layout of a blisk that can be used in a turbine or a turbomachine compressor, for example.

2. Description of the Related Art

It is conventional that blades are provided with bulbs engaged in grooves notched into the disk, which hold the blades in place on the disk despite centrifugal forces that occur during operation. The grooves may be oriented along the axis of the disk and each may contain a bulb, or they may be circular and contain all the bulbs. The bulbs usually comprise oblique upper faces that bear on overhanging faces with the same obliqueness as the groove when centrifugal forces are applied. Inclinations of the groove relative to a median plane are sufficient so that no jamming occurs between these faces when centrifugal forces have ceased.

The invention is based on a wish to build some blades from a composite material such as CMC (Ceramic Matrix Composite). The difficulty that then arises is that the method of manufacturing by casting, compulsory for these materials, prevents excessive discontinuities in the orientation and therefore makes it essential that the inclination of the upper part of the bulb connected to the outer part of the blade in the radial direction should not exceed about 30°, while the inclination of the faces overhanging the groove has to be at least 40° to prevent jamming. Therefore, such blades cannot be directly integrated into a disk. The invention overcomes this problem.

BRIEF SUMMARY OF THE INVENTION

In its general form, it relates to a layout comprising a disk and at least one blade, the bulb of which is housed in a groove in the disk, the groove comprising two faces overhanging a bottom of the groove with a first inclination relative to a median plane of the groove, characterised in that the bulb comprises two upper faces located under the overhanging faces but with a second inclination relative to said median plane that is less than the first inclination, and in that inserts are added between the bulb and the disk, which include main parts arranged between the overhanging faces and the upper faces, external parts connected to the main parts, extending through an opening in the groove and on a peripheral face of the disk, the distance between them increasing towards the free ends opposite the main parts, and internal parts connected to the main parts, extending between the bulb and the bottom of the groove, the distance between them reducing towards the free ends opposite the main parts.

The thickness of the main parts is variable, the inclination of their opposite faces being equal to the inclination of the overhanging face or upper face located in front of them, and therefore compensate for their difference in inclination, while the external parts hold inserts in position at rest by bearing on the peripheral face of the disk, and the internal parts have the same effect during operation, possibly bearing in contact with the bulb.

Therefore, this design of composite material blades can be used in a metal disk, and the inserts can also be metallic. According to one advantageous characteristic, the inserts are separated from each other at the internal parts to avoid the risk of creating any jamming by arching of the internal parts; and according to another advantageous characteristic, in an operating state in which the bulb is bearing on the central parts and the central parts are bearing on the overhanging faces, there are clearances between the external parts and the disk and between the internal parts and the bulb. As a result of this characteristic, the blade and then the inserts can drop towards the bottom of the groove when centrifugal forces cease, to prevent jamming.

DETAILED DESCRIPTION OF THE INVENTION

The invention will now be described with reference to the FIGURE that shows a layout conforming with the invention in an operating state of the machine, in which centrifugal forces are applied on the different elements.

A groove (1) is formed in a disk (2) and it contains a bulb (3) of a blade (4). The groove (1) comprises a bottom face (5) and then two oblique overhanging faces (6) leading to an opening in the groove (1) leading to a peripheral face (7) of the disk (2). The bulb (3) also comprises a bottom face (8) above the face of the groove (2) and two oblique upper faces (9) in front of the overhanging faces (6) of the groove (1), and that are connected to the outer part of the blade (4). The bottom face (8) of the bulb (3) is connected to the upper faces (9) through a large radius rounding (10) that enables fabrication when the blade (4) is made of a composite material, but such rounding is not possible between the upper faces (9) and the outer part of the blade (4), such that the inclination of the upper faces (9) (measured from an imaginary median plane of the groove (1) defined by a local radial direction (R) of the disk (2) and an axial direction (A) of the groove (1) and the bulb (3)) is less than the inclination required for the overhanging faces (6) of the groove (1). Inserts (11) are then inserted between the bulb (3) and the wall of the groove (1). Each comprises a central part (12), an external part (13) and an internal part (14), the external and internal parts being attached to the central part (12) through its opposite ends. The central part (12) of each of the inserts (11) extends between an overhanging face (6) and an upper face (9) corresponding to it, and its opposite lateral faces have the same inclination as the face in front of them, such that the bulb (3) bears on the inserts (11) through first bearing surfaces (15) and the inserts (11) bear on the overhanging faces (6) through second bearing surfaces (16). The external parts (13) are curved outwards from the groove and overhang the peripheral face (7) of the disk (2) from which they are separated by clearances. The internal parts (14) are curved towards the middle of the groove (1) and extend towards each other from the central parts (12), but do not touch each other. Clearances separate them from the bottom (5) of the groove and from the bottom (8) of the bulb (3).

Satisfactory support of the blade (4) in the groove (1) is guaranteed by sufficiently large surface areas of the bearing surface contact areas (15 and 16) through which centrifugal forces applied on the blade (3) are transmitted to the disk (2) with a low contact pressure. And when the machine returns to rest and centrifugal forces cease, the bulb (3) and the inserts (11) drop to the bottom of the groove, the bottom (8) of the bulb (3) bearing on the internal parts (14) and the external parts (13) bearing on the peripheral face (7) without any jamming.

The invention claimed is:

1. A layout of a blisk, comprising:

a disk; and at least one blade with a bulb which is housed in a groove in the disk, the groove comprising two overhanging faces overhanging a bottom face of the groove, the overhanging faces presenting a first inclination relative to a median plane of the groove, wherein the bulb comprises two upper faces located under the overhanging faces and including a second inclination relative to said median plane that is less than the first inclination, a bottom face of the bulb is above the bottom face of the groove, and first and second inserts are inserted between the bulb and the disk, each of the first and second inserts includes central parts arranged between the overhanging faces and the upper faces, external parts connected to the central parts at a first end of the central parts, the external parts extending through an opening in the groove and on a peripheral face of the disk, a distance between the external parts of the first and second inserts increasing towards free ends of the external parts of the first and second inserts opposite the central parts, and internal parts connected to the central parts at a second end of the central parts, free ends of the internal parts being disposed between the bottom face of the bulb and the bottom face of the groove at an innermost portion of the groove, a distance between the internal parts of the first and second inserts reducing towards the free ends of the internal parts of the first and second inserts opposite the central parts, and wherein, in a rest state, the internal parts of the first and second inserts are sandwiched between the bottom face of the groove and the bottom of the bulb, and the external parts of the first and second inserts abut the peripheral face of the disk.

2. The layout according to claim 1, wherein the blades are made of a composite material and the disk is made of metal.

3. The layout according to claim 1, wherein the inserts are separated from each other at the internal parts.

4. The layout according to claim 1, wherein, in an operating state in which the bulb bears on the central parts and the central parts bear on the overhanging faces, clearances exist between the external parts and the disk and between the internal parts and the bulb.

5. The layout according to claim 1, wherein a gap is provided between the free ends of the internal parts of the first and second inserts, and the bottom face of the groove faces the bottom of the bulb through the gap.

6. The layout according to claim 1, wherein the free ends of the internal parts of the first and second inserts extend towards the median plane of the groove and towards each other.

7. The layout according to claim 4, wherein, in the operating state, another clearance exists between the bottom face of the groove and the internal parts of the inserts.

* * * * *